United States Patent [19]

Sollami et al.

[11] Patent Number: 4,702,525

[45] Date of Patent: Oct. 27, 1987

[54] CONICAL BIT

[76] Inventors: Phillip A. Sollami, 1300 E. Pine; Jimmie L. Sollami, 8400 S. 84th Ct., both of Herrin, Ill. 62948

[21] Appl. No.: 840,216

[22] Filed: Mar. 17, 1986

Related U.S. Application Data

[63] Continuation-in-part of Ser. No. 721,047, Apr. 8, 1985, abandoned.

[51] Int. Cl.[4] ..... E21C 35/18

[52] U.S. Cl. ..... 299/79; 175/410; 299/86

[58] Field of Search ..... 299/79, 86, 91, 94; 175/410; 37/142 R

[56] References Cited

U.S. PATENT DOCUMENTS

| | | | |
|---|---|---|---|
| 3,476,438 | 11/1969 | Bower | 299/86 |
| 3,519,309 | 7/1970 | Engle et al. | 299/86 |
| 3,599,737 | 8/1971 | Fischer | 175/410 X |
| 3,932,952 | 1/1976 | Helton et al. | 175/410 X |
| 4,168,923 | 9/1979 | Vezirian | 175/410 X |
| 4,277,106 | 7/1981 | Sahley | 299/79 |
| 4,474,488 | 10/1984 | Pinkerton et al. | 175/410 X |
| 4,627,665 | 12/1986 | Ewing et al. | 175/410 X |

FOREIGN PATENT DOCUMENTS

| | | | |
|---|---|---|---|
| 2633779 | 2/1978 | Fed. Rep. of Germany | 175/410 |
| 1114156 | 5/1968 | United Kingdom | 299/86 |
| 1419900 | 12/1975 | United Kingdom | 299/86 |

OTHER PUBLICATIONS

Smith Mining Tools, "Conical Mining Bits", 10/1982.

"Tooth-Type Insert Bits Get More Work", *The Oil and Gas Journal,* vol. 67, No. 30, 7-1969.

*Primary Examiner*—Stephen J. Novosad

*Assistant Examiner*—David J. Bagneil

*Attorney, Agent, or Firm*—Edmond T. Patnaude

[57] ABSTRACT

A miner bit has a base portion formed of two different metallic members welded together, one being adapted to be mounted to a continuous mining machine and the other having a frustoconical end portion welded to a frustoconical tungsten carbide bit.

8 Claims, 8 Drawing Figures

CONICAL BIT

This is a continuation-in-part application of co-pending prior application Ser. No. 06/721,047, filed on Apr. 8, 1985, now abandoned, by Phillip A. Sollami and Jimmie L. Sollami for a Conical Bit.

The present invention relates in general to abrasion bits of the type used in mining or in breaking up hard materials such as coal, rock, concrete and the like, and in one embodiment the invention relates more particularly to a new and improved plumb bob type bit having a rigid metal base with an axial opening at one end in which is mounted a tungsten carbide insert having a frustoconical tip which has a sufficiently large diameter and a sufficiently large included angle to substantially reduce abrasion of the portion of the metal base which is adjacent to the tungsten carbide tip.

BACKGROUND OF THE INVENTION

For many years there has been used in the coal mining industry continuous mining machines in which a plurality of generally conical bits known as a plumb bob bits are used. The body or base of each bit is an iron or steel casting or forging having a frustoconical front end nose portion provided with an axial hole in which a tungsten carbide insert is mounted. The tungsten carbide insert extends from the front end of the nose portion of the metal body and provides the cutting surface of the bit. The tungsten carbide inserts of the prior art had a diameter which was about one-third or less the minimum diameter of the frustoconical nose portion of the base.

In use a large number of such bits are mounted for free axial rotation in the outer surface of a rotary drum, or in the outer surface of a continuous chain or the like, and the bits are moved through an orbit which is intercepted by the face of the material being mined. The bits contact the material being mined at a small angle relative to their longitudinal axes, and the bits are thus rotated about their respective longitudinal axes as they travel across and through the material being mined. Such bits have had to be frequently removed and discarded or sharpened, and they have had a relatively short life primarily because the portions of the base material adjacent the tungsten carbide was worn away as the bits moved through the material being mined.

Another problem with the prior art bits has been the breakage of the sharp tips when the bits are initially put into use.

A serious problem in the coal mining industry has been the ignition of methane gas released from pockets where the gas has been trapped in the material being mined. It is believed that a primary cause of such ignition is the heat which is frictionally developed as the bits move through the coal and rock during the mining operation. It is also possible that the sparking which occurs when the metal base portions of the bits strike rock causes ignition of the methane gas.

SUMMARY OF THE INVENTION

Briefly, there is provided in accordance with a preferred embodiment of the present invention a new and improved mining type bit having a tungsten carbide insert disposed in a recess at the end of a frustoconical nose portion on the body of the bit, the nose portion being formed of steel and the diameter of the base portion of the insert being at least half the diameter at the distal end of the frustoconical nose portion of the body. The tip has a conical side wall which lies flush with and is coextensive with the conical side wall of the adjacent nose portion and has an included angle in the range of 60 degrees to 70 degrees.

The tip of the present invention is thus substantially larger in diameter than are the prior art tips and this new tip dramatically increases the life of the bit, increases the time between required sharpenings and reduces the temperature of the bit and of the material being mined to lessen the possibility of gas ignition in a mine. These advantages result from the fact that the metal nosepiece does not abrade the material being mined. Rather, the large tungsten carbide tip creates a percussive effect which substantially shatters the coal or rock before the metal nose part moves against and through it. A visual comparison was made of two bits which were used for the same period of time in the same continuous mining machine, one bit embodying the present invention and the other being a prior art type bit. The prior art type shows appreciable wear or wash-away of the metal nose portion adjacent the tip while no substantial wear or wash-away of the metal nose portion of the bit of the present invention was observed. Because of the fact that the coefficient of friction of tungsten carbide is substantially less than that of iron or steel, less heat is generated as the bit of the present invention cuts through the coal and rock, wherefore the possibility of gas ignition is reduced.

In accordance with another feature of the present invention the bit is initially formed so that the tungsten carbide insert is substantially conical but has a distal end which is not pointed but is elongated in a direction transverse to the central longitudinal axis of the bit. I have found that the tips having this novel shape do not break off as do some of the pointed bits wherefore the overall average life of the bits is substantially increased.

GENERAL DESCRIPTION OF THE DRAWINGS

DETAILED DESCRIPTION OF A PREFERRED EMBODIMENT OF THE INVENTION

Figure 1:
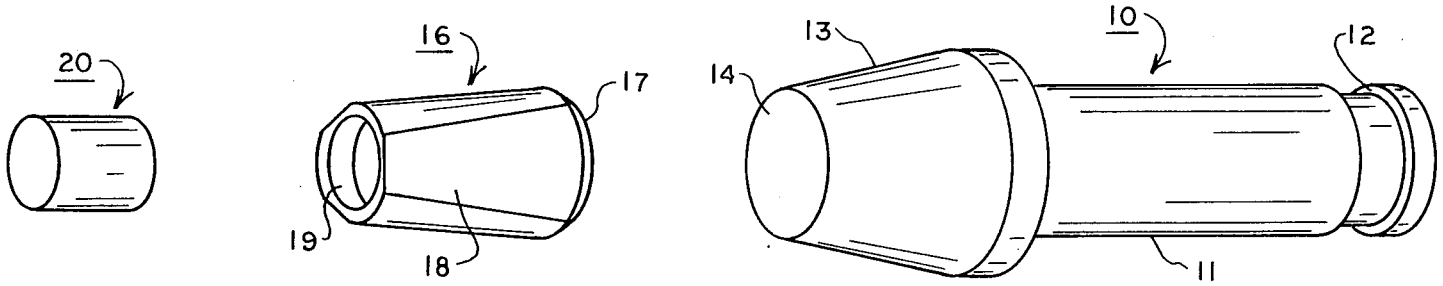
FIG. 1 is an exploded perspective view illustrating the parts of a plumb bob bit embodying the present invention during an early stage of manufacture.

Referring particularly to FIG. 1, a base member 10 may be seen to include a generally cylindrical shank portion 11 having an annular groove 12 near the rearward end and a frusto-conical portion 13 immediately adjacent to the shank portion 11. The part 10 is a one-piece member which may be cast or forged iron, steel or other suitable rigid material. The frusto conical portion 13 has a planar face 14.

A second base member 16 has a planar face 17 which, like the face 14, is circular and has substantially the same diameter as does the face 14. The base member 16 has three flats 18 along its side and a relatively shallow cylindrical recess 19 at its end opposite the base 17. The base member 16 has a generally frustoconical shape and tapers inwardly toward the end having the recess 19 therein.

A cylindrical solid plug of tungsten carbide or other suitable abrasive material 20 has an outer diameter slightly less than the diameter of the recess 19 so that it may be brazed into the recess 19.

Figure 2:
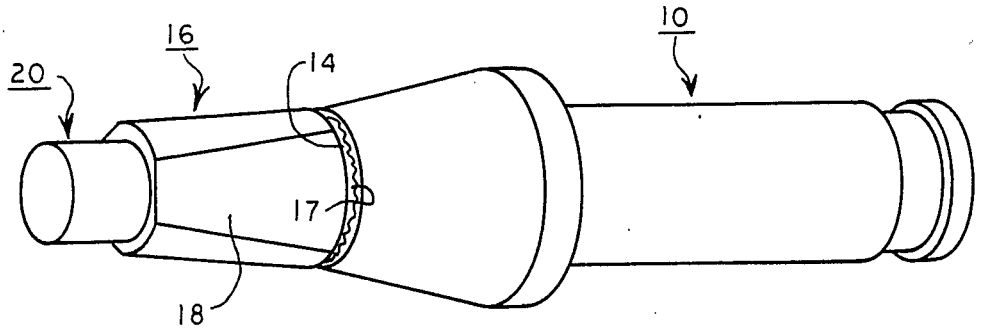
FIG. 2 is a perspective view showing the individual parts of FIG. 1 in mutually assembled relationship.

FIG. 2 shows the parts of FIG. 1 assembled together in an intermediate stage in the manufacture of a miner bit embodying the present invention. As there shown, the faces 14 and 17 of the base parts 10 and 16 have been spun-welded or electric-welded together and the tungsten carbide plug has been brazed into the recess 19.

The flats 18 are provided on the base member 10 to facilitate holding of the member 16 in a chuck while the parts 10 and 16 are spun relative to one another at a high speed so as to provide the spin weld junction between the surfaces 14 and 17. The flats also reduce the amount of metal adjacent to the conical surface of the tip thus preventing contact with the coal or rock. The plug 20 is suitably braised or welded into the recess 19.

Figure 3:
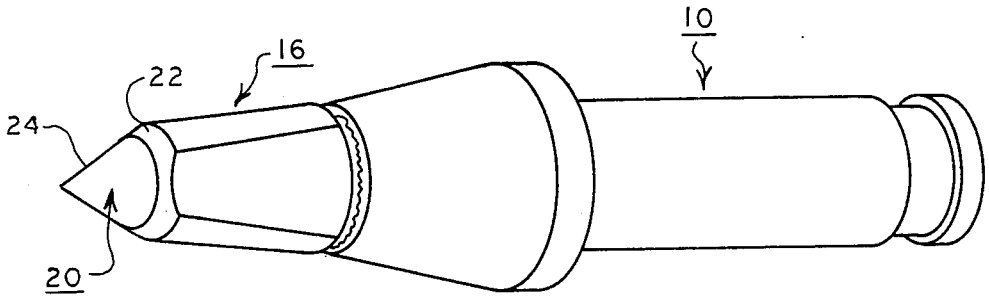
FIG. 3 is a perspective view showing a completed bit embodying the present invention.

FIG. 3 shows the final bit wherein the tungsten carbide plug 20 and the base member 16 have been ground to provide a frusto-conical end 22 on the base part 16 and a coextending frusto-conical surface 24 on the tungsten carbide plug 20. When desired, the tip plug 20 may have the conical end preformed thereon, thereby eliminating the need to grind the plug after it has been assembled to the base member 16.

Figure 4:
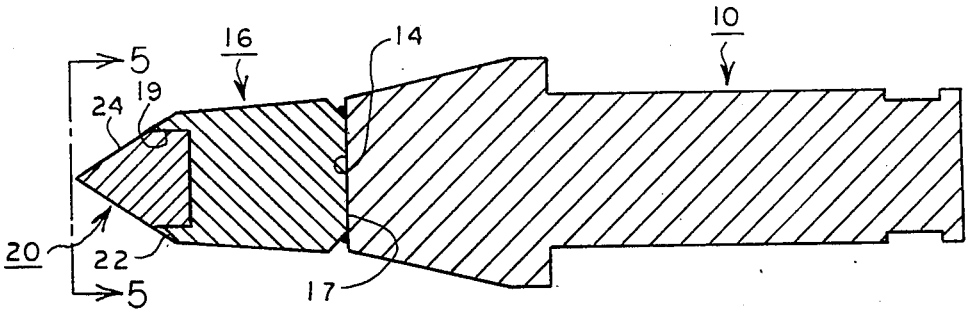
FIG. 4 is a longitudinally cross-sectioned view of the bit of FIG. 3.
Figure 5:
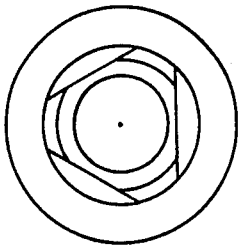
FIG. 5 is a cross sectional view taken along the line 5—5 of FIG. 4.

FIG. 4 shows a longitudinally sectioned view of the plumb bob type bit shown in FIG. 3. The included angle between diametrically opposite locations on the face 24 of the tungsten carbide bit is substantially less than that of the prior art and is an angle within the range of 60 degrees to 70 degrees. Moreover, the base diameter of the tungsten carbide bit 20, i.e., the diameter of the recess 19, is no less than 0.563 inch and may be as great as 0.625 inch. In the prior art, the normal maximum diameter of the carbide tip in a plumb bob type miner bit was 0.360 inch. Also, in the prior art type bit the entire base, i.e., the part corresponding to the parts 10 and 16 of the present invention, was a single cast forged member and the frusto conical nose was not coextensive with the conical surface of the carbide tip, i.e., the included angle of the metal nose portion was substantially greater than the included angle of the carbide tip.

In accordance with one aspect of the present invention the base part 16 is formed of a non-sparking material such as a non-sparking stainless steel while the base portion 10 is formed of a less expensive different material. Inasmuch as only the forward part 16 can engage the material being mined, the fact that the rear portion 10 is formed of a sparking metal, is of no consequence. However, should the nose portion 16 strike a hard rock or the like no sparking will occur.

Figure 7:
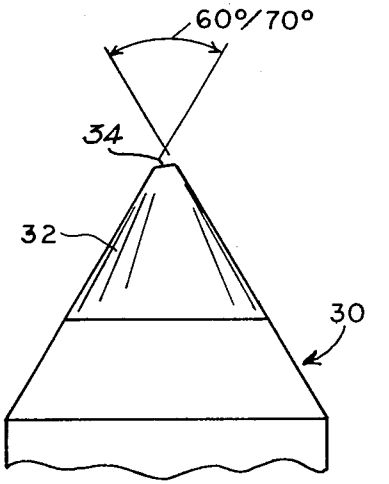
FIG. 7 is an elevational view from the bottom of FIG. 6.
Figure 8:
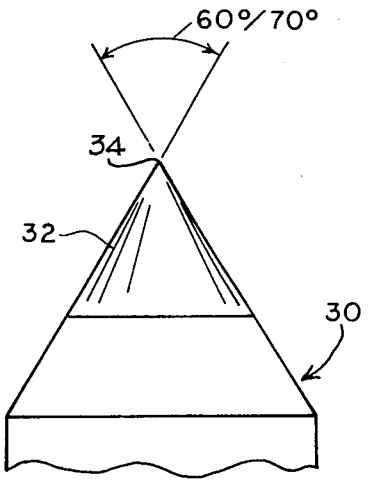
FIG. 8 is an elevational view taken from the right side of FIG. 6.
Figure 6:
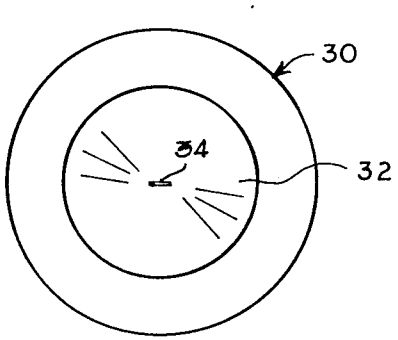
FIG. 6 is an end view of a plumb bob but embodying another feature of the present invention.

Referring to FIGS. 6, 7 and 8 there is shown the nose portion 30 of a plumb bob coal mining bit of the type generally shown in FIGS. 3 and 4. The nose portion 30 differs from the corresponding portion of the previously described bit in that the tungsten carbide insert 32 has an elongated flattened distal end 34. The remainder of the exposed portion of the tip 32 is generally conical and has an included angle in the range of 60 degrees to 70 degrees. In a tip having a base diameter of five-eights of an inch the tip end 34 has a length of about one-sixteenth of an inch as shown in FIG. 7. The construction of the tip 30 has a substantially longer life than do the sharply pointed tips of the prior art because of the reduction in the breakage of the tip ends when the bits are initially used.

It has been found that the bit of the present invention operates substantially cooler than do the bits of the prior art. This is believed to be the result of the fact that the larger diameter and smaller included angle of the tip results in a substantially smaller contact area between the material being mined and the base part 16. Inasmuch as the coefficient of friction of tungsten carbide is substantially less than that of steel, the frictional heat generated will be considerably less. In addition, however, it is believed that the larger diameter and the smaller included angle of the tip 20 provides a percussive effect which fractures the coal before it is engaged by the frusto conical nose surface 24 of the base part 16. As noted hereinbefore, a visual examination of a miner bit constructed in the manner shown in FIGS. 3 and 4 does not show any appreciable wear or wash away of the base part 16 in the vicinity of the tip 20. Prior art types of bits show considerable wear in these same areas and it is believed that because of such wear the prior art tips are subject to breakage and have a short operable life as compared to those of the present invention.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A bit for mining coal, said bit being of the type wherein said bit is adapted to be forced into the exposed surface of the coal being mined, comprising an elongated metal base having a first end portion adapted to be rotatably mounted to a mining machine and having a second end portion, said second end portion being frustoconical and having therein a cylindrical hole extending along the longitudinal axis of said base, a tungsten carbide percussion tip having a cylindrical end portion, said end portion being disposed in said hole and affixed to said base, the portion of said tip extending from said base having a generally frustoconical surface and extending axially from said second end portion of said base, and said tip having at the end thereof opposite said cylindrical end portion an elongated flattened surface which is delineated by said generally frustoconical surface and which is elongated in a direction transverse to the principal longitudinal axis of said bit.

2. A bit according to claim 1 wherein said base comprises a base section formed of a first steel, and said second end portion being formed of a second steel different from said first steel.

3. A bit according to claim 2 wherein said second steel is non-sparking.

4. A bit according to claim 2 wherein said sections of said base are welded together.

5. A bit according to claim 1 wherein
said tip has a diameter at the base of said frustoconical end portion which is not less than nine-sixteenths of an inch.

6. A bit according to claim 1 comprising
a plurality of flats on said second end portion of said metal base.

7. A bit according to claim 6 wherein
said second end portion has a distal end, and
said flats extend rearwardly from said distal end of said second end portion.

8. A bit according to claim 1 comprising a plurality of angularly spaced flats on said second end portion of said metal base in juxtaposition with said generally frustoconical portion of said tip,
said flats defining relief areas to cause intermittent rotation of said bit.

* * * * *